US009672834B2

(12) United States Patent
Pandey et al.

(10) Patent No.: US 9,672,834 B2
(45) Date of Patent: Jun. 6, 2017

(54) DYNAMIC RANGE COMPRESSION WITH LOW DISTORTION FOR USE IN HEARING AIDS AND AUDIO SYSTEMS

(71) Applicant: Indian Institute of Technology Bombay, Powai, Mumbai, Maharashtra (IN)

(72) Inventors: Prem Chand Pandey, Mumbai (IN); Nitya Tiwari, Mumbai (IN)

(73) Assignee: Indian Institute of Technology Bombay, Mumbai (IN)

( * ) Notice: Subject to any disclaimer, the term of this patent is extended or adjusted under 35 U.S.C. 154(b) by 0 days.

(21) Appl. No.: 15/113,271

(22) PCT Filed: Jan. 27, 2015

(86) PCT No.: PCT/IN2015/000049
§ 371 (c)(1),
(2) Date: Jul. 21, 2016

(87) PCT Pub. No.: WO2015/111084
PCT Pub. Date: Jul. 30, 2015

(65) Prior Publication Data

US 2016/0336015 A1 Nov. 17, 2016

(30) Foreign Application Priority Data

Jan. 27, 2014 (IN) ..... 290/MUM/2014

(51) Int. Cl.
*G10L 19/022* (2013.01)
*H04R 25/00* (2006.01)

(52) U.S. Cl.
CPC ..... *G10L 19/022* (2013.01); *H04R 25/353* (2013.01); *H04R 25/356* (2013.01); *H04R 25/505* (2013.01); *H04R 2430/03* (2013.01)

(58) Field of Classification Search
None
See application file for complete search history.

(56) References Cited

U.S. PATENT DOCUMENTS 5,500,902 A 3/1996 Stockham et al.
5,832,444 A 11/1998 Schmidt
(Continued)

OTHER PUBLICATIONS

Tiwari, Nitya et al., "Real-time Implementation of Multi-band Frequency Compression for Listeners with Moderate Sensorineural Impairment," Proc. 13th Annual Conf. Int. Speech Communication Association (Interspeech 2012), Portland, Oregon, Sep. 9-13, 2012, Paper No. 689.

(Continued)

*Primary Examiner* — Curtis Kuntz
*Assistant Examiner* — Kenny Truong
(74) *Attorney, Agent, or Firm* — Pepper Hamilton LLP

(57) ABSTRACT

Dynamic range compression in the hearing aids is provided for restoring normal loudness of low level sounds without making the high level sounds uncomfortably loud. An apparatus along with a method using sliding-band compression is disclosed for significantly reducing the temporal and spectral distortions generally associated with the currently used single and multiband compression techniques. It; uses a frequency-dependent gain function calculated on the basis of auditory critical bandwidth based short-time power spectrum and the specified hearing thresholds, compression ratios, and attack and release times. It is realized using FFT-based analysis-synthesis and can be integrated with other FFT-based signal processing in hearing aids and audio systems.

15 Claims, 7 Drawing Sheets

(56) References Cited

U.S. PATENT DOCUMENTS

| | | | |
|---|---|---|---|
| 6,097,824 | A | 8/2000 | Lindemann et al. |
| 6,873,709 | B2 | 3/2005 | Hou |
| 8,014,550 | B2 | 9/2011 | Bramslow |
| 8,116,491 | B2 | 2/2012 | Chalupper |
| 8,290,190 | B2 | 10/2012 | Hau et al. |
| 8,600,076 | B2 | 12/2013 | Choi et al. |
| 2003/0220801 | A1 | 11/2003 | Spurrier |
| 2006/0233408 | A1 | 10/2006 | Kates |
| 2010/0266143 | A1 | 10/2010 | Oliver |
| 2011/0320210 | A1 | 12/2011 | Vickers |
| 2013/0287236 | A1 | 10/2013 | Kates |

OTHER PUBLICATIONS

N. Magotra et al., "Development and fixed-point implementation of a multiband dynamic range compression (MDRC) algorithm," Conference Record of the Thirty-fourth Asilomar Conference on Signals, Systems and Computers, 2000 (ACSSC 2000), vol. 1, pp. 428-432).

D. W. Griffin et al., "Signal estimation from modified short-time Fourier transform," IEEE Transactions on Acoustics, Speech, and Signal Processing, vol. 32(2), pp. 236-243, 1984.

International Search Report mailed Aug. 25, 2015 in corresponding International Patent Application No. PCT/IN2015/000049.

DYNAMIC RANGE COMPRESSION WITH LOW DISTORTION FOR USE IN HEARING AIDS AND AUDIO SYSTEMS

This application is a national phase filing under 35 U.S.C. 371 of International Patent Application No. PCT/IN2015/000049, filed Jan. 27, 2015, which claims the benefit of Indian Patent Application No. 290/MUM/2014, filed Jan. 27, 2014, each of which is incorporated herein by reference in its entirety.

FIELD OF INVENTION

The present invention relates to the field of signal processing for audio systems, and more specifically relates to the dynamic range compression of audio signals.

BACKGROUND OF THE INVENTION

Most of the listeners with sensorineural hearing loss have a significant frequency-dependent elevation of hearing threshold levels without a corresponding increase in the uncomfortable loudness levels. Thus they have a significantly reduced dynamic range of hearing and abnormal growth of loudness, known as loudness recruitment. Such listeners have a significantly degraded speech perception and generally do not benefit much by use of linear amplification which makes the high level sounds intolerably loud. Dynamic range compression is a process which reduces the dynamic range of an audio signal. It reduces the level differences between the high and low level parts of audio signals in order to amplify the low level sounds without making the high level sounds intolerably loud. It is also advantageous in applications where the audio circuitry or the sound reproducing device of the audio system cannot handle the full dynamic range of the input signal.

The primary disadvantage of the existing available systems is that they can introduce audible distortions offsetting the advantages of dynamic range compression. These distortions may be particularly annoying to the hearing-impaired listeners with abnormal growth of loudness.

The most commonly used compression systems employ single band compression with the gain dependent on the dynamically varying signal level. As the power in speech signal is mostly contributed by the low-frequency components, the amplification of the high-frequency components in these systems gets affected by the level of the low-frequency components. Thus the high frequency components may become inaudible and distortions in temporal envelope may get introduced. As a solution to these problems, several multiband compression systems have been reported. In these systems, the spectral components of the input signal are divided in multiple bands and the gain for each band is calculated on the basis of signal power in that band. Use of multiple bands reduces distortions in the temporal envelope, but it decreases the spectral contrasts and modulation depths in the speech signal, which may have an adverse effect on the perception of certain speech cues. The spectral shape of a formant (spectral resonance in speech signal) falling at the boundary between two adjacent bands may get distorted due to different gains applied in these bands. Further, formant transitions over the boundary between two adjacent bands may lead to perceptible discontinuities. The frequency response of the multiband compression systems has a time-varying magnitude response without corresponding changes in the phase response, which can cause audible distortions, particularly for non-speech audio.

It is to be noted that compression function is generally specified in terms of a compression ratio and a knee-point above which the compression becomes applicable. Such a compression function may not provide an appropriate compression for the abnormal loudness growth curve of the listener.

Schmidt (J. C. Schmidt, "Apparatus for dynamic range compression of an audio signal," U.S. Pat. No. 5,832,444, 1998) has described a dynamic range compression technique for improving perceptual transparency. It is based on the use of auditory critical bands, attack and release rates for adaptation of the compressor gain to changes in the input level, use of variable weightings of RMS and peak envelope for gain control, and keeping the long-term output RMS envelope close to the desired value. The technique does not address the problem of distortions during spectral transitions across the bands.

Stockham et al. (T. G. Stockham, Jr., D. M. Chabries, "Hearing aid device incorporating signal processing techniques," U.S. Pat. No. 5,500,902, 1996) have described a multiband compression technique which uses an AGC block associated with each band. This block transforms the band-pass filtered signal to the log domain and separates the carrier and envelope using eighth-order elliptic high-pass and low-pass filters, respectively. The envelope is multiplied with a gain depending on the compression function. The modified logarithmic envelope is summed with logarithm of the carrier and the exponential operation is used to get the band output. The outputs corresponding to different bands are summed to get the compressed output. The system does not address the problem of distortions during spectral transitions across the bands.

Yet another multi-channel compression technique is described by Hau et al. (O. Hau, C. Ludvigsen, "Method for sound processing in a hearing aid and a hearing aid," U.S. Pat. No. 8,290,190B2, 2012). It combines the advantages of slow and fast compression systems but does not address the problem of distortions during spectral transitions across the bands.

Bramslow (L. Bramslow, "System for controlling a transfer function of a hearing aid," U.S. Pat. No. 8,014,550B2, 2011) has described a multi-channel compression method using a combination of maximum-level detector with fast time constants, squelch level detectors with slow time constants, and compressors with intermediate time constants and look-up tables in accordance with the hearing loss characteristics for gain calculation in each band. But it does not address the problem of distortions during spectral transitions across the bands.

Kates (J. M. Kates, "Hearing aid with improved compression," US patent application publication No. US2013/0287236A1, 2013) has described a compression system using multiple warped frequency channels to provide a higher frequency resolution at lower frequencies and a low frequency resolution at higher frequencies. It uses a linear gain provided it is sufficient to keep the speech above the hearing threshold, otherwise the gain is slowly increased or a minimal amount of dynamic range compression is introduced. The algorithm has three sets of time constants: (i) the attack and release times to detect signal peaks and valleys, (ii) the rate at which g50 and g80 (gains at 50 and 0 dB SPL) are varied in response to peak and valley estimates, and (iii) the rate at which the signal dynamics are actually modified using compressor input/output rule. However, it does not address the problem of distortions during spectral transitions across the bands.

Magotra et al. (N. Magotra, S. Kamath, F. Livingston, M. Ho, "Development and fixed-point implementation of a multiband dynamic range compression (MDRC) algorithm," Conference Record of the Thirty-fourth Asilomar Conference on Signals, Systems and Computers, 2000 (ACSSC 2000), vol. 1, pp. 428-432) have described use of a Taylor's series approximation for gain calculation in the digital implementation of multi-band compression, but the method does not address the problem of distortions during spectral transitions across the bands.

Chalupper et al. (J. Chalupper, M. Fruhmann, "Method for the dynamic range compression of an audio signal and corresponding hearing device", U.S. Pat. No. 8,116,491B2, 2012) describes a multi-channel dynamic range compression system which applies compression on modulation spectrum rather than in time or frequency domain to avoid distortion in the modulation spectra and to retain the phase information. To overcome its limitation in terms of appropriate value of time slot to be used for FFT based modulation spectrum calculation, use of coherent demodulation and modulation filtering based compression of modulation spectrum has been proposed. The technique requires carrier frequency detection to separate modulation envelope and carrier in each band. It does not address the problem of distortions during spectral transitions across the bands.

Hou (Z. Hou, "Method and apparatus for filtering and compressing sound signals," U.S. Pat. No. 6,873,709, 2005) has described a multiband compression system aimed at improving speech audibility and intelligibility at low levels and preserving spectral contrast at high levels. In this method, the input signal is filtered by a set of band-pass filters and the estimated signal level in each band is used to determine the initial value of the gain. The gain for each band is constrained by combining its initial value with those associated with the neighbouring bands. The system does not address the problem of distortions during spectral transitions across the bands.

Choi et al. (Y. Choi, M. S. Kim, "Multiband DRC system and method for controlling the same," U.S. Pat. No. 8,600,076B2, 2013) have described a compression system aimed at increasing the overall loudness and minimizing the distortions at the band crossover frequencies. It decomposes the input signal into N bands with N−1 crossover frequencies. Compression in each band is performed using a threshold based on the target total harmonic distortion and the chosen N−1 crossover frequencies. If the difference between the gains of any two compression channels exceeds an upper limit, the gain controller controls the difference by limiting the gain of one of the two to avoid distortions at the band boundaries. The technique has a post-compression stage to limit the sudden amplitude changes at the crossover frequencies. However, the system does not fully avoid the problem of distortions during spectral transitions across the bands.

Lindemann et al. (E. Lindemann, T. L. Worrall, "Continuous frequency dynamic range audio compressor," U.S. Pat. No. 6,097,824A, 2000) have described a multi-band dynamic range compressor with the aim of being well behaved for narrowband as well as wide band signals. It uses a heavily overlapped filter bank to reduce the ripple in frequency responses. The system does not fully avoid the problem of distortions during spectral transitions across the bands.

There is therefore a need to mitigate the disadvantages associated with the method and systems explained above.

OBJECTIVE

It is the primary objective of the present invention to provide a signal processing method and apparatus for use in hearing aids and audio systems to compensate for frequency-dependent loudness recruitment associated with sensorineural hearing loss.

SUMMARY

Present invention discloses a method and a system using sliding-band compression for dynamic range compression in audio systems and more specifically in hearing aids to compensate for frequency-dependent loudness recruitment associated with sensorineural hearing loss without introducing the distortions generally associated with the single band and multiband compression systems. It uses a frequency-dependent gain function calculated dynamically from short-time spectrum of the signal. The gain for each spectral sample is calculated on the basis of power in a band centered at it. It avoids discontinuities in the spectrum and in the temporal envelope. Further it uses an analysis-synthesis method which masks any phase related discontinuities. It is suitable for use with speech and non-speech audio signals. A two-dimensional look-up table is used for gain calculation in accordance with the short-time spectrum of the signal. It reduces the computational requirement and permits use of a frequency-dependent compression function most suited to compensate for the abnormal loudness growth function of the hearing-impaired listener. The preferred embodiment uses FFT-based analysis-synthesis which can be integrated with other FFT-based signal processing techniques like noise suppression and signal enhancement for use in the hearing aids and audio systems. It can be implemented on a hardware using a codec and a DSP processor with on-chip FFT hardware.

DETAILED DESCRIPTION

The present invention discloses dynamic range compression in audio systems by using sliding-band compression and more specifically in hearing aids to compensate for frequency-dependent loudness recruitment associated with sensorineural hearing loss without introducing the distortions generally associated with the single band and multi-band compression systems. It uses a frequency-dependent gain function calculated dynamically from short-time power spectrum of the signal. The gain for each spectral sample is calculated on the basis of power in a band centered at it. The bandwidth is selected to approximate the frequency resolution of the auditory system and changes from a small value at the low frequency end of the spectrum to a large value at the higher frequency end. It can be selected as one-third octave bandwidth, bandwidth corresponding to equal increments on the mel scale, or auditory critical bandwidth. The time-varying power in the band is used to calculate a target gain for its center frequency. The target gain and the values of attack and release times are used to calculate the gain as function of frequency. The target gain is calculated on the basis of the specified hearing threshold and compression ratio using a linear relationship on logarithmic scale or using a look-up table. Use of a look-up for relating the target gain to the band power reduces the computational requirements and it can be used for providing a frequency-dependent compression function most suited to compensate for the abnormal loudness growth curve of the hearing-impaired listener.

The disclosed method is implemented as a feed-forward compression system. As the gain for a spectral component is determined by the spectral components located within a band centered on it, the method avoids the possibility of attenuation of high frequency components due to the presence of strong low frequency components, as may happen in single band compression. The disclosed method results in a time-varying frequency response with the magnitude response being smooth along time and frequency axes. Therefore, it avoids the possibility of distortions in the temporal envelope which may happen in case of multiband compression. Further, it avoids distortions in the shape of format and other spectral resonances and the transitions in the resonance frequencies do not result in discontinuities in the processed output. The disclosed method is implemented using an analysis-synthesis technique based on least-square error minimization to avoid perceptible distortions caused by changes in the magnitude response without introducing appropriate changes in the phase response.

Figure 1:
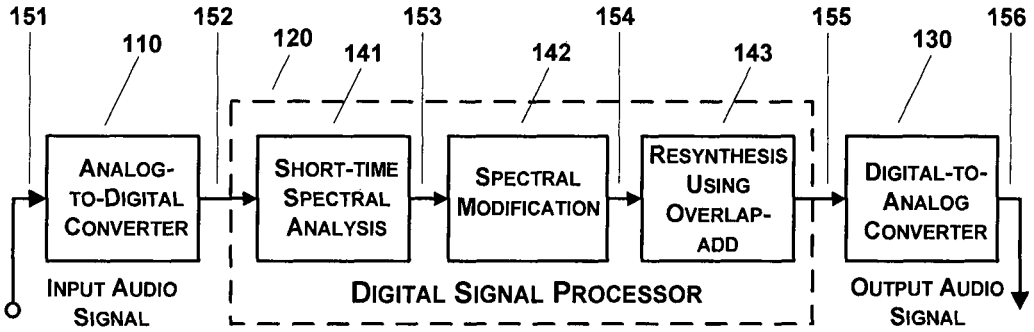
FIG. 1 is a schematic illustration of sliding-band compression system using spectral modification in accordance with an aspect of the present disclosure.

FIG. 1 illustrates an implementation of the sliding-band compression method for dynamic range compression of analog audio signals. It consists of an analog-to-digital converter (ADC) 110, digital signal processor 120, and digital-to-analog converter (DAC) 130. The processing uses a analysis-synthesis platform based on discrete Fourier transform (DFT) and consists of short-time spectral analysis block 141, spectral modification block 142, and resynthesis block 143. The analog input signal 151 is converted into digital samples 152 and applied as input to the short-time spectral analysis 141. This block comprises windowing, zero-padding, and calculation of the complex spectrum using DFT. Its output 153 is given as input to the spectral modification block 142. Spectral modification for dynamic range compression consists of frequency-dependent gain calculation and calculation of the modified complex spectrum as the output 154 which is applied as input to the resynthesis block 143. The digital output signal 155 is resynthesized using inverse discrete Fourier transform (IDFT), windowing, and overlap-add and it is output as analog audio signal 156 through the DAC 130.

Figure 2:
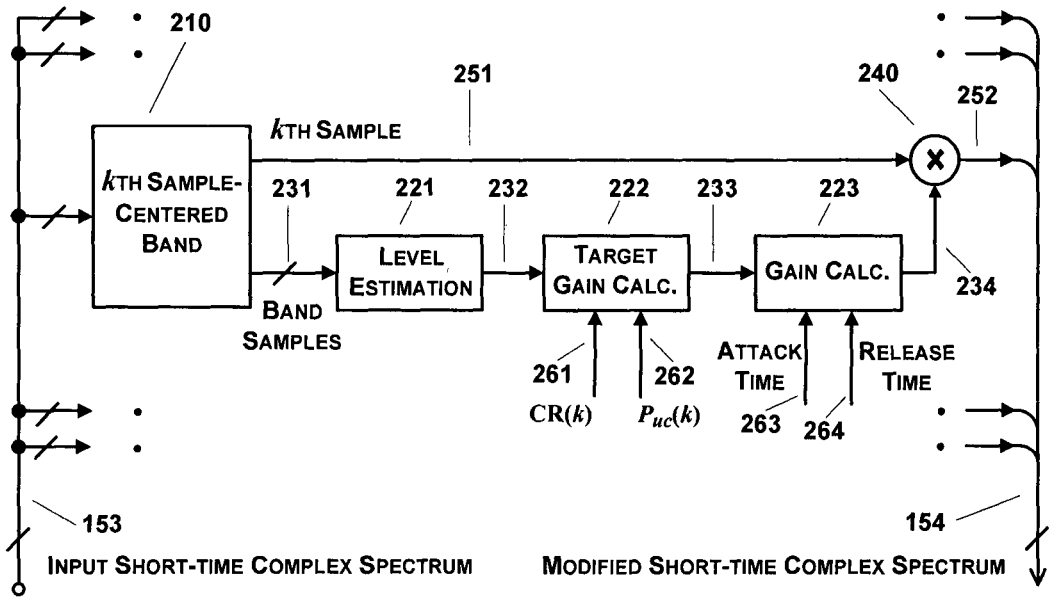
FIG. 2 is a schematic illustration of spectral modification for sliding-band compression system in accordance with an aspect of the present disclosure.

In spectral analysis, the speech segment obtained after windowing is zero padded to form a sequence of length say N and N-point DFT is used to get the complex spectrum. The processing for spectral modification using feed-forward gain compression is illustrated in FIG. 2. For each discrete frequency sample k of the input complex spectrum 153, there is a processing path for calculating the frequency-dependent gain 234 and it consists of the level estimation block 221, target gain calculation block 222, and gain calculation block 223. For auditory critical bandwidth based compression system, the bandwidth at the frequency sample k can be approximated as the following $$BW(k)=25+75(1+1.4f^2)^{0.69} \tag{1}$$

where f is the frequency of kth spectral sample in kHz. For the band 210 centered at k, the band power $P_{in}(k)$ 232 is calculated as sum of the squared magnitude of its spectral samples 231 by the level estimation block 221. A compression function relating the input power $P_{in}$ and the output power $P_o$ in order to compensate for the abnormal growth of loudness is used to calculate the required gain and it is taken as the target value. In the target gain calculation block 222, the target gain 233 is calculated using compression ratio (CR(k)) 261 and maximum power at upper comfortable listening level ($P_{uc}(k)$) 262. The gain calculator block 223 calculates the present gain value 234 as a smooth change from the previous value towards the target value, using ratio steps in accordance with the set values of attack time 263 and release time 264. The kth spectral sample 251 is multiplied with the gain 234 using multiplier 240 to obtain the output spectral sample 252. The N output samples together give the modified complex spectrum 154.

The most commonly used compression function to compensate for the reduced dynamic range is a linear relation between input power $P_{in}$ and the output power $P_o$ on a dB scale. For the band centered at spectral sample k, the relationship is given as $$\left[\frac{P_o(k)}{P_{uc}(k)}\right]_{dB} = \frac{1}{CR(k)}\left[\frac{P_{in}(k)}{P_{uc}(k)}\right]_{dB} \tag{2}$$

where $P_{uc}(k)$ is the power corresponding to the upper comfortable listening level and CR(k) is the compression ratio. The relationship can also be written as $$\frac{P_o(k)}{P_{uc}(k)} = \left[\frac{P_{in}(k)}{P_{uc}(k)}\right]^{1/CR(k)} \tag{3}$$

This relation results in a target gain for the spectral sample k as $$G_t(k) = \text{antilog}_{10}\left(0.05\left[1 - \frac{1}{CR(k)}\right]\left[\frac{P_{uc}(k)}{P_{in}(k)}\right]_{dB}\right) \quad (4)$$

The computations involved in the log-based gain calculations or those based on approximation series based calculations are not suitable for use with sliding-band compression as it involves gain calculation at each of the frequency samples. Therefore, the target gain calculation is carried out using a two-dimensional look-up table relating the input power with gain as a function of frequency. It significantly reduces the computational requirement, although it increases the memory requirement. Further, it permits use of a frequency-dependent compression function most suited to compensate for the abnormal loudness growth curve of the hearing-impaired listener.

The gain is changed smoothly from the previous value towards the calculated target value in accordance with the specified attack and release times. A fast attack may be used to avoid the output level from exceeding the uncomfortable listening level during transients, and a slow release may be used to avoid the pumping effect or amplification of breathing. In the DFT based implementation, the gain applied to kth spectral sample in ith frame is given as $$G(i, k) = \begin{cases} \max[G(i-1, k)/\gamma_a, G_t(i, k)], & G_t(i, k) < G(i-1, k) \\ \min[G(i-1, k)\gamma_r, G_t(i, k)], & G_t(i, k) > G(i-1, k) \end{cases} \quad (5)$$

Here $\gamma_a$ and $\gamma_r$ are the gain ratios for the attack phase and the release phase, respectively. These are given as $$\gamma_a = (G_{max}/G_{min})^{1/s_a} \quad (6)$$

$$\gamma_r = (G_{max}/G_{min})^{1/s_r} \quad (7)$$

where $G_{max}$ is the maximum target gain corresponding to minimum input level, and $G_{min}$ is the minimum target gain corresponding to maximum input level. The parameters $s_a$ and $s_r$ are the number of steps during attack and release, respectively and are selected to set the specified attack time $T_a$ and release times $T_r$ as $T_a = s_a S/f_s$, $T_r = s_r S/f_s$ where $f_s$ is sampling frequency, and S is the number of samples for window shift. The input complex spectrum is multiplied with the gain function to obtain the output spectrum which is used for resynthesizing the output signal.

Modifications in the short-time magnitude spectrum without corresponding changes in the phase spectrum can result in audible distortions, particularly for non-speech audio. A least-square error based estimation of the signal from the modified short-time complex spectrum as proposed by Griffin et al. (D. W. Griffin, J. S. Lim, "Signal estimation from modified short-time Fourier transform," IEEE Transactions on Acoustics, Speech, and Signal Processing, volume 32(2), pp. 236-243, 1984) is used as the analysis-synthesis platform for sliding-band compression in order to avoid distortions caused by modification in the short-time magnitude spectrum. The processing steps involved in the analysis-synthesis are the same as shown in FIG. 1. For short-time spectral analysis, the input signal is segmented using L-sample frames with 75% overlap. The segmented frames are multiplied by an analysis window. The samples are zero-padded and N-point DFT is calculated to obtain the short-time complex spectrum. After spectral modification, the output signal is re-synthesized by using N-point IDFT and overlap-add after multiplying the output segment with the analysis window. The analysis window should meet the requirement that sum of the squares of all the overlapped window samples is unity. For window length L and window shift S=L/4 corresponding to 75% overlap, this requirement is met by modified Hamming window, given as $$w(n) = [1/\sqrt{(4d^2+2e^2)}][d + e\cos(2\pi(n+0.5)/L)] \quad (8)$$

with d=0.54 and e=−0.46.

For evaluation, the method was implemented for sampling frequency of 10 kHz and window length L=256 (25.6 ms). A 75% overlap-add was used corresponding to a window shift S=64. Analysis-synthesis was carried out using 512-point FFT (fast Fourier transform) and IFFT (inverse fast Fourier transform). Auditory critical bandwidth as approximated in Equation-1 was used for defining the bands for sliding-band compression. For generating the two-dimensional look-up table for the compression function, the range of band power was quantized into twenty logarithmic intervals. Thus with 512-point FFT, there are 256×20 entries in the look-up table. It results in an acceptable trade-off between the requirements of smooth gain changes and look-up table size acceptable for real-time implementation using a DSP (digital signal processing) chip. Changing the maximum value of input power corresponds to a change in the threshold values, which can be adjusted according to hearing loss characteristics. Setting the parameters $s_a$ and $s_r$ equal to one and 30, respectively, corresponds to attack and release times of 6.4 ms and 192 ms, respectively.

Figure 3:
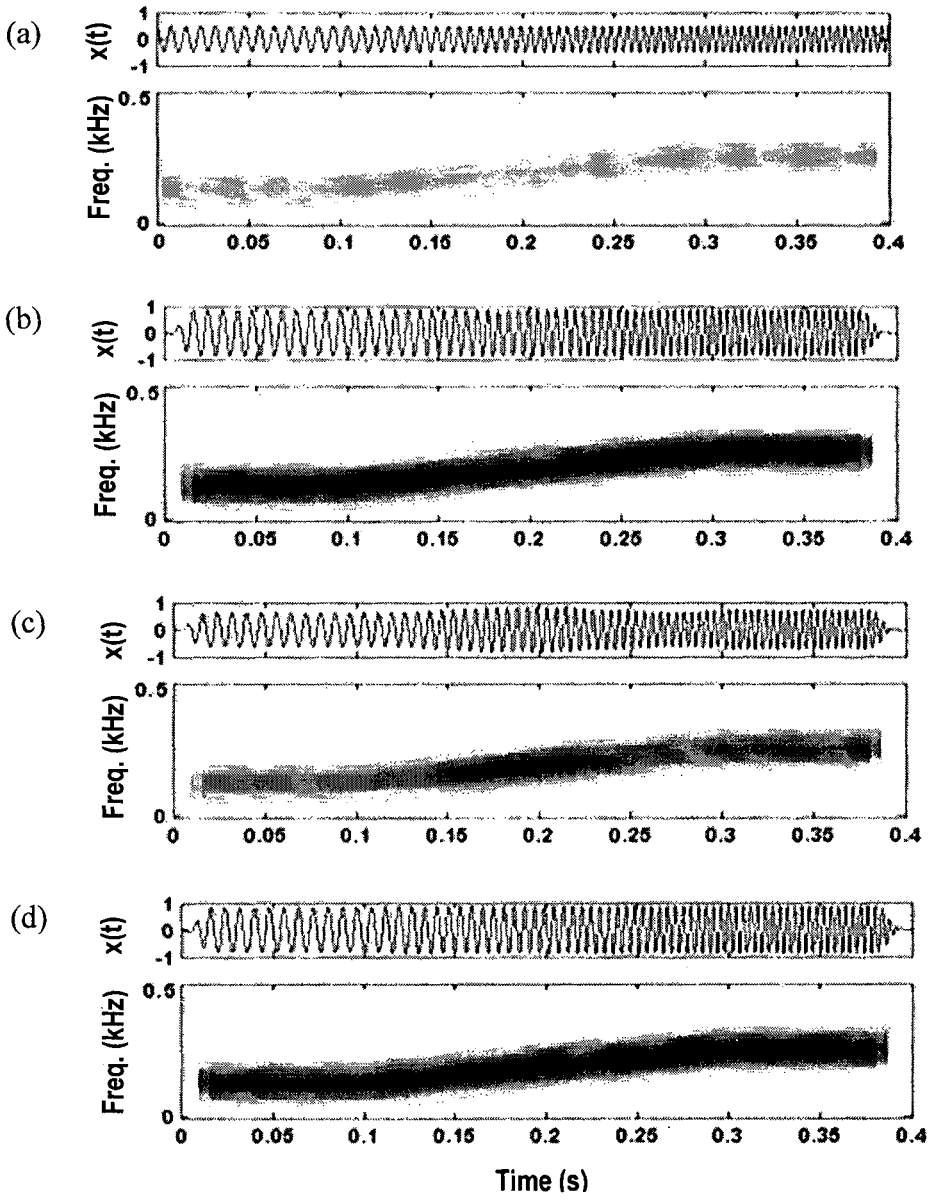
FIG. 3 shows an example of processing of a sinusoidal waveform with constant amplitude and frequency linearly swept from 125 Hz to 250 Hz over 200 ms and with compression ratio (CR) of 30 in accordance with an aspect of the present disclosure. Panel-a of the figure shows the unprocessed waveform and its spectrogram. Panel-b of the figure shows the output processed using single band compression and its spectrogram. Panel-c of the figure shows the output processed using multiband compression and its spectrogram. Panel-d of the figure shows the output processed using sliding-band compression and its spectrogram.

FIG. 3 illustrates the result of the differences in the processed outputs of single-band, multiband, and sliding-band compression on signals with spectral transitions. The compression was applied on an input consisting of a sinusoidal wave with constant amplitude and changing frequency. A compression ratio of 30 was used in all the three compressions. Multiband and sliding-band compressions were applied with bandwidths corresponding to auditory critical bands. The panel-a of the figure shows the input waveform with its frequency linearly swept from 125 Hz to 250 Hz over 200 ms. It also shows the corresponding spectrogram. Output of single-band compression shown in panel-b of the figure does not exhibit any ripples in the amplitude. Panel-c of the figure shows output of the multiband compression. Its temporal envelope has ripples caused by changes in the gain during the transition of the tone frequency over the band boundaries. Output of the sliding-band compression is shown in panel-d of the figure and it does not exhibit ripples in the amplitude. Similar results were obtained for different swept tones and narrowband noises with swept center frequencies. These results confirm that the sliding-band compression is successful in avoiding the distortions which occur in multiband compression during spectral transitions.

Figure 4:
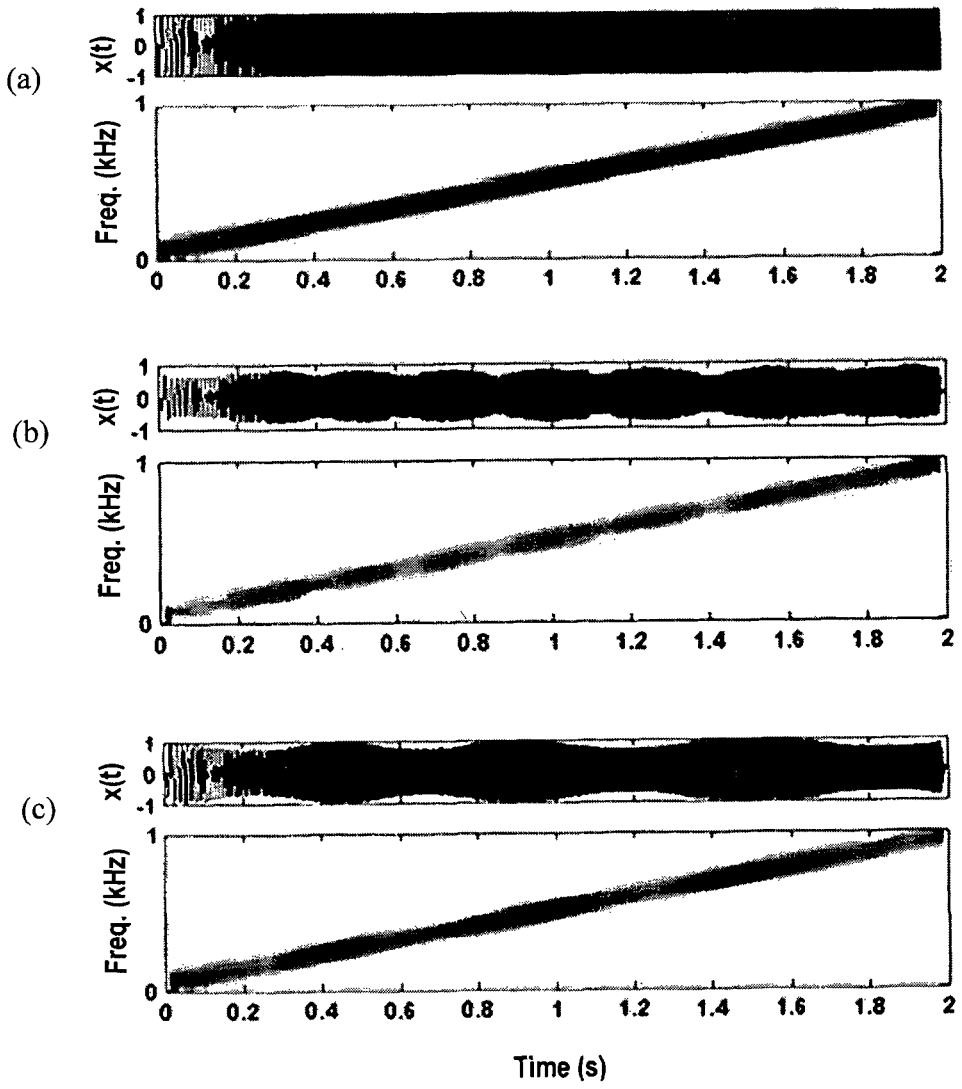
FIG. 4 shows an example of processing of a sinusoidal waveform with constant amplitude and frequency linearly swept from 100 Hz to 1000 Hz over 2 s and with CR of 2 and 30 for alternate critical bands in accordance with an aspect of the present disclosure. Panel-a of the figure shows the unprocessed waveform and its spectrogram. Panel-b of the figure shows the output processed using multiband compression and its spectrogram. Panel-c of the figure shows the output processed using sliding-band compression and its spectrogram.

To observe the effect of different compression factors in adjacent bands in the processed outputs of multiband and sliding-band compressions, a sinusoidal wave with frequency linearly swept from 100 Hz to 1 kHz over 2 s was given as input to these systems. The compression ratios used in alternate critical bands are 2 and 30. The results are shown in FIG. 4. The input waveform and its spectrogram are shown in panel-a of the figure. The processed output from the multiband compression, shown in panel-b of the figure, has discontinuities in its temporal envelope during the transition of the tone frequency over the band boundaries. The output of the sliding-band compression, shown in panel-c of the figure, has smooth variation in the temporal envelope as caused by changes in the compression ratio in the alternate bands.

Figure 5:
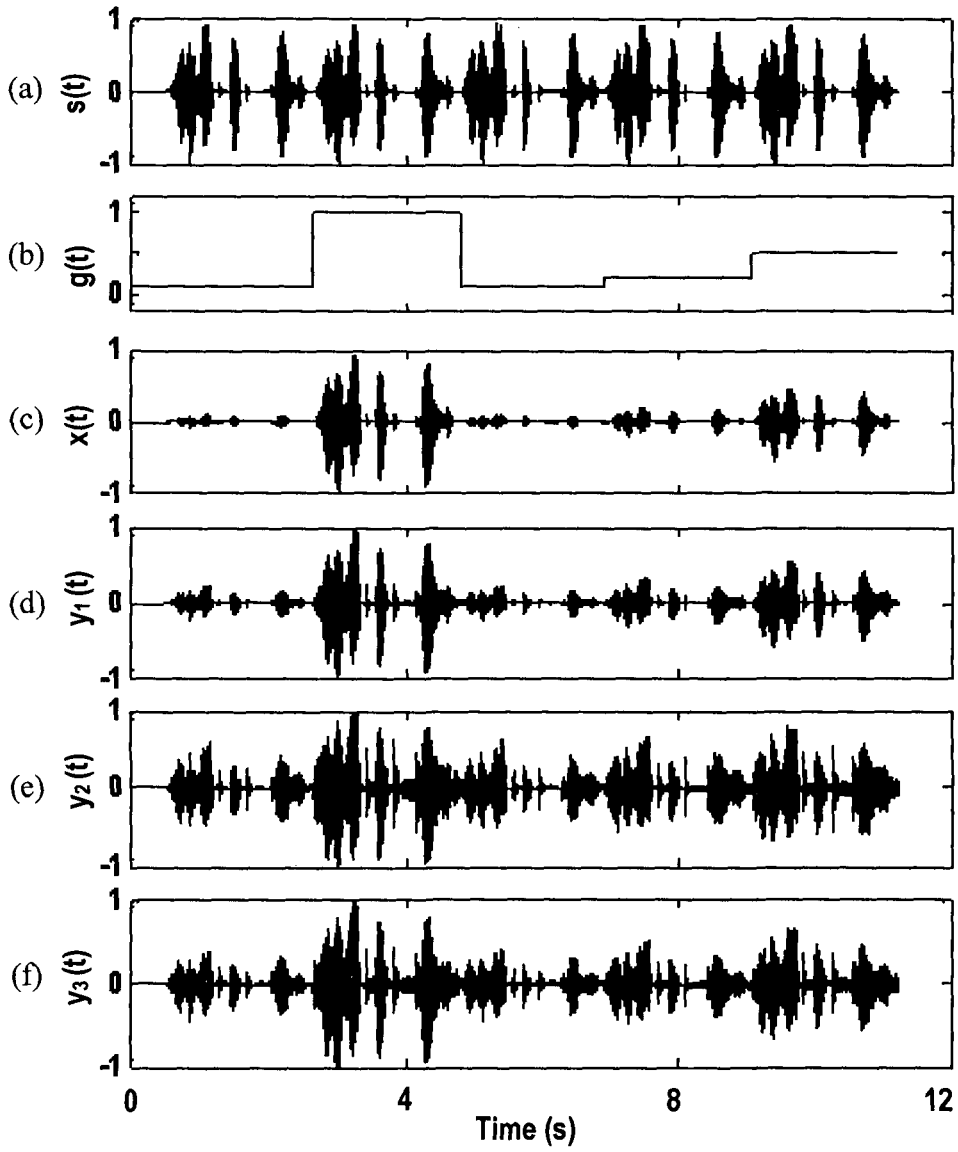
FIG. 5 shows an example of processing of the waveform of the sentence "you will mark ut please" concatenated with scaling factors of 0.1, 1, 0.1, 0.2, and 0.5 in accordance with an aspect of the present disclosure. Panel-a of the figure shows concatenation of the waveforms. Panel-b of the figure shows the scaling factor. Panel-c of the figure shows the input waveform obtained after scaling. Panel-d of the figure shows the processed output with CR of 2. Panel-e of the figure shows the processed output with CR of 30. Panel-f of the figure shows the processed output with CR of 2 and 30 for alternate critical bands.

FIG. 5 illustrates an example of the result of the sliding-band compression for speech with large variation in the level. The speech material shown in panel-a of the figure consists of five concatenations of an English sentence "you will mark ut please". It is multiplied with a time-varying scale factor with values of 0.1, 1, 0.1, 0.2, and 0.5 as shown in panel-b of the figure to get the speech signal with large variation in its level. The resulting waveform, as shown in panel-c of the figure, is applied as the input waveform for sliding-band compression. Panel-d of the figure shows the output with CR of 2, and panel-e of the figure shows the output with CR of 30. Panel-f of the figure shows the output for CR of 2 and 30 in alternate bands. It is observed that the dynamic range compression is achieved without any distortions in the temporal envelope. Examination of spectrograms of the outputs showed that compression did not result in distortions during formant transitions. The system was applied on a wide variety of speech material, music, and environmental sounds with a large variation in the sound level. No perceptible distortions were noticed in the processed outputs.

The technique was implemented for real-time processing on a low-power DSP chip for its use in audio systems and more specifically in hearing aids. The implementation uses a DSP board based on the 16-bit fixed point processor TI/TMS320C5515. The processor supports a maximum clock rate of 120 MHz and has 16 MB address space with 320 KB on-chip RAM (including 64 KB dual access RAM), and 128 KB on-chip ROM. It features three 32-bit programmable timers, four DMA controllers each with four channels, and a tightly coupled FFT hardware accelerator supporting 8 to 1024-point FFT. The DSP board "eZdsp", with 4 MB on-board NOR flash for user program and codec TLV320AIC3204 with stereo ADC and DAC supporting 16/20/24/32-bit quantization and sampling frequency of 8-192 kHz, was used for the implementation. The input samples from ADC (analog-to-digital converter) are acquired by one of the DMA channels and output to DAC (digital-to-analog converter) by another DMA (direct memory access) channel at a sampling rate of 10 kHz. The program was written in C, using TI's "CCStudio, ver. 4.0" as the development environment.

Figure 6:
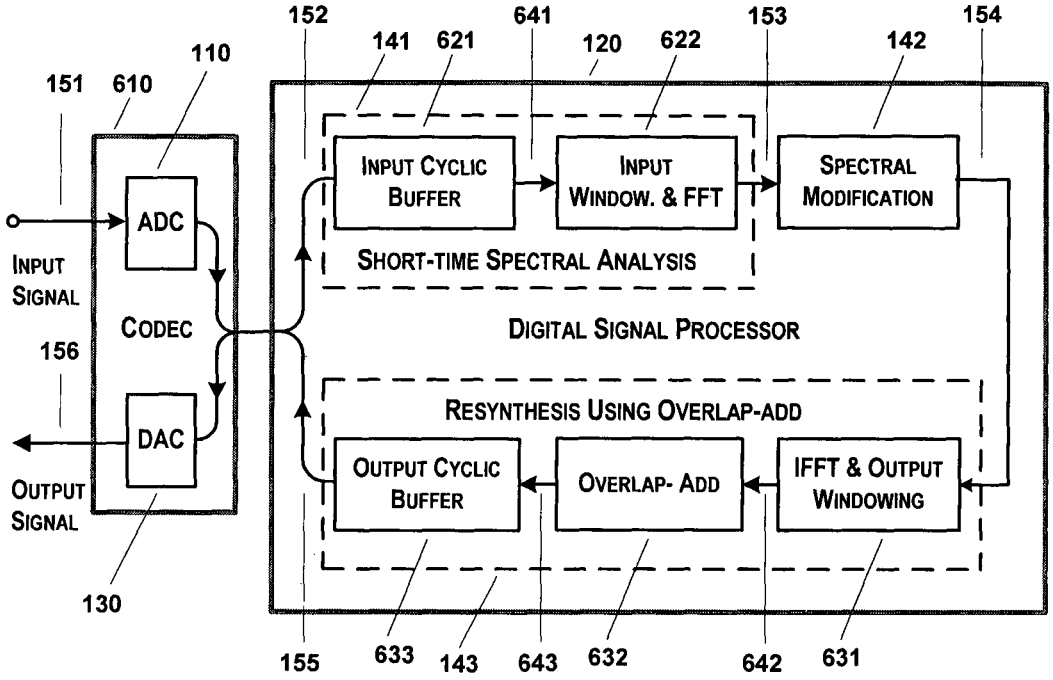
FIG. 6 is a schematic illustration of implementation of sliding-band dynamic range compression on a DSP board with a codec and a DSP chip in accordance with an aspect of the present disclosure.

FIG. 6 illustrates real-time implementation of the sliding-band compression method. It consists of an audio codec 610 and a digital signal processor 120. Audio codec 610 comprises of ADC 110 and DAC 130. The analog input signal 151 is converted into digital samples 152 using ADC 110 and is applied as input to the short-time spectral analysis 141. This block comprises of block 621 for input cyclic buffering and block 622 for windowing, zero-padding, fast Fourier transform (FFT). Its output 153 is given as input to the spectral modification block 142. Spectral modification involves frequency-dependent gain calculation and calculation of the modified complex spectrum as the output 154 which is applied as input to the resynthesis block 143. The resynthesis block 143 consists of a block 631 for inverse fast Fourier transform (IFFT) and output windowing, block 632 for overlap-add, and block 633 for output cyclic buffering. The time domain digital signal 642 is obtained from IFFT and output windowing is given as input to overlap-add block 632. The digital signal obtained after overlap-add 643 is stored in the output cyclic buffer 633. The resynthesized digital output signal 155 is output through DAC 130 as analog audio signal 156.

Figure 7:
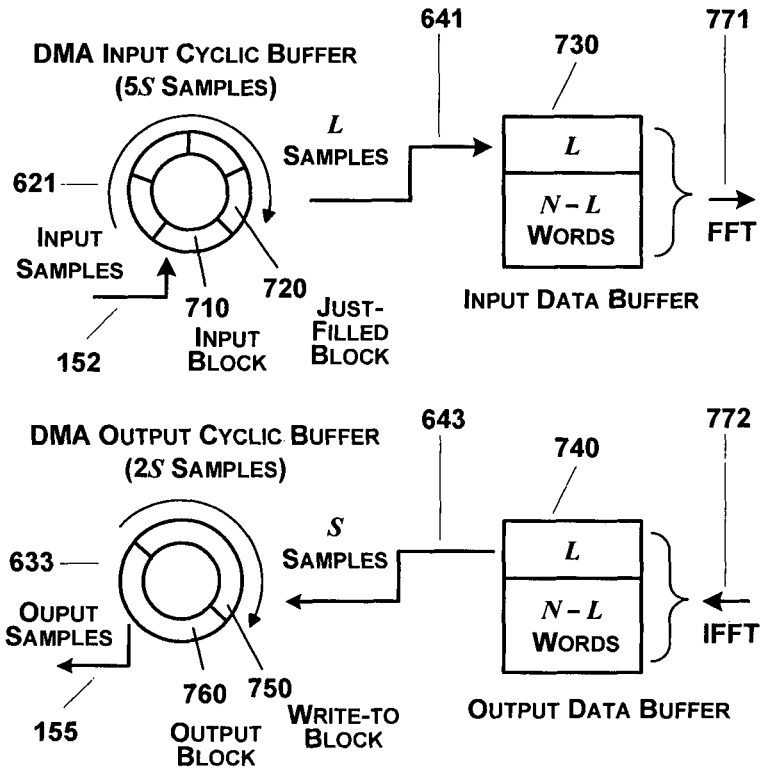
FIG. 7 is a schematic illustration of data transfer and buffering operations on the DSP board using DMA-based input-output and cyclic buffers in accordance with an aspect of the present disclosure.

FIG. 7 shows the data transfer and buffering operations involved in the process. To reduce the conversion overheads, the input samples, spectral values, and the processed samples are all stored as 4-byte words with 16-bit real and 16-bit imaginary parts. The input samples 152 are stored in a 5-block DMA input cyclic buffer. 621 with S-word blocks. To keep a track of the current input block 710, just-filled input block 720, current output block 760, and write-to output block 750, cyclic pointers are used. The pointers are initialized to 0, 4, 0, and 1, respectively and are incremented at every DMA interrupt generated when a block gets filled. The DMA-mediated reading from ADC and writing to DAC are continued. Input window 641 with L samples is formed using the samples of the just-filled block 750 and the previous three blocks. These L samples multiplied by modified Hamming window of length L are copied to the input data buffer 730. These samples padded with N-L zero-valued samples serve as input 771 to N-point FFT. This method of data handling is used for an efficient realization of 75% overlap and zero padding. The spectral samples 772 obtained from N-point IFFT are stored in output data buffer 740. The S samples 643 obtained after output windowing and overlap-add are copied in write-to block 750 of the 2-block DMA output cyclic buffer 633. The output samples 155 from current output block 760 are then given to DAC for digital-to-analog conversion.

The processed output from the DSP board was perceptually similar to the corresponding output from the offline implementation for speech as well as other audio signals. PESQ-MOS for speech outputs from the real-time processing with those from the offline processing was 3.50, indicating that the processing artifacts due to fixed-point processing were not significant. The processing needed approximately 41% of the maximum available processing capacity at a processor clock of 120 MHz and the total signal delay (algorithmic delay, computation delay, and input-output delay) was found to be approximately 36 ms. It shows that the sliding-band compression can be implemented on a fixed-point processor with on-chip FFT hardware and the spare processing capacity can be used for combining it with other FFT based signal processing techniques for noise suppression and signal enhancement.

The invention has been described above with reference to its application in hearing aids to compensate for the abnormal loudness growth associated with the sensorineural hearing loss. It can also be used in other audio devices for dynamic range compression with low temporal and spectral distortions, wherein the processing is carried out using a processor interfaced to analog-to-digital converter and digital-to-analog converter for processing analog audio signals. The invention can also be used in audio devices with a processor operating on digitized audio signals available in the form of digital samples at regular intervals or in the form of data packets. In addition to its application in hearing aids and audio devices meant for listeners with hearing impairment, the invention can also be used in applications where the audio circuitry or the sound reproducing device of the audio system cannot handle the full dynamic range of the input signal.

The above description along with the accompanying drawings is intended to describe the preferred embodiments of the invention in sufficient detail to enable those skilled in the art to practice the invention. The above description is intended to be illustrative and should not be interpreted as limiting the scope of the invention. Those skilled in the art to which the invention relates will appreciate that the many variations of the described example implementations and other implementations exist within the scope of the claimed invention.

We claim:

1. A method of dynamic range compression with low temporal and spectral distortions for use in hearing aids and audio devices, wherein a digitized input signal is processed by sliding-band compression comprising the steps of:

multiplying samples of said input signal with an analysis window to form overlapping frames;

calculating short-time complex spectrum of said input signal by applying discrete Fourier transform (DFT) on said overlapping frames;

calculating short-time power spectrum by summing a square of magnitude of samples of said complex spectrum lying in a band centered at each frequency sample;

calculating target gain for each frequency sample using said power spectrum and a given frequency-dependent compression function;

calculating a gain for each frequency sample of said complex spectrum using said target gain and selected attack and release times;

multiplying each frequency sample of said complex spectrum with said gain to obtain an output complex spectrum;

calculating an output segment by applying inverse discrete Fourier transform (IDFT) on said output complex spectrum; and resynthesizing an output signal by applying overlap-add on said output segment.

2. The method as claimed in claim 1, further comprising: calculating a frequency-dependent compression function from specified hearing thresholds and compression ratios to compensate for frequency-dependent loudness recruitment associated with sensorineural hearing loss.

3. The method as claimed in claim 1, wherein the target gain is calculated as a function of frequency using the given frequency-dependent compression function as a linear relationship on logarithmic scale between the short-time power spectrum and the output complex spectrum.

4. The method as claimed in claim 1, wherein the target gain is calculated as a function of frequency using a two-dimensional look-up table providing the given frequency-dependent compression function most suited to compensate for an abnormal loudness growth curve of an ear of a hearing-impaired listener.

5. The method as claimed in claim 1, wherein the gain is changed smoothly from a previous value towards the calculated target gain in accordance with the selected attack and release times.

6. The method as claimed in claim 5, wherein a fast attack is used to avoid an output level from exceeding an upper comfortable listening level during transients, and a slow release is used to avoid a pumping effect or amplification of breathing.

7. The method as claimed in claim 1, wherein a bandwidth of the band centered at each frequency sample for calculating the short-time power spectrum is selected to approximate a frequency resolution of an auditory system, wherein the bandwidth changes from a small value at a low frequency end to a large value at a higher frequency end.

8. The method as claimed in claim 7, wherein the bandwidth is selected as one-third octave bandwidth, the bandwidth corresponding to equal increments on a mel scale, or auditory critical bandwidth.

9. The method as claimed in claim 1, wherein an analysis-synthesis technique based on least-square error minimization is used to avoid perceptible distortions caused by changes in a magnitude response dissociated from a phase response during compression of speech and non-speech audio signals.

10. The method as claimed in claim 1, wherein an analysis-synthesis technique based on fast Fourier transform (FFT) is integrated with other FFT-based spectral modifications used in processing of the input signal.

11. The method as claimed in claim 1, wherein a feed-forward compression system is used for the sliding-band compression.

12. An apparatus for dynamic range compression with low temporal and spectral distortions for use in hearing aids and audio devices, the apparatus comprising:

an analog-to-digital converter to convert analog input signal to digital signal;

a digital signal processor for sliding-band compression to modify the digital signal from said analog-to-digital converter; and a digital-to-analog converter to convert the modified digital signal from said digital signal processor as an output analog signal;

wherein the sliding-band compression comprises the steps of:

multiplying samples of said digital signal with an analysis window to form overlapping frames;

calculating short-time complex spectrum of said digital signal by applying discrete Fourier transform (DFT) on said overlapping frames;

calculating short-time power spectrum by summing a square of magnitude of samples of said complex spectrum lying in a band centered at each frequency sample;

calculating target gain for each frequency sample using said power spectrum and a given frequency-dependent compression function;

calculating a gain for each frequency sample of said complex spectrum using said target gain and selected attack and release times;

multiplying each frequency sample of said complex spectrum with said gain to obtain an output complex spectrum;

calculating an output segment by applying inverse discrete Fourier transform (IDFT) on said output complex spectrum; and resynthesizing an output signal by applying overlap-add on said output segment.

13. The apparatus as claimed in claim 12, wherein the digital signal processor comprises on-chip FFT hardware.

14. The apparatus as claimed in claim 12, wherein the analog-to-digital converter and the digital-to-analog converter are configured for input and output, respectively, using DMA (direct memory access) and cyclic buffering for computationally efficient overlap-add operation for analysis-synthesis.

15. An apparatus for dynamic range compression with low temporal and spectral distortion for use in audio devices, comprising a digital signal processor processing digitized audio signals available in a form of digital samples at regular intervals or in a form of data packets, wherein said digital signal processor performs sliding-band compression comprising the steps of:

multiplying samples of said input signal with an analysis window to form overlapping frames;

calculating short-time complex spectrum of said input signal by applying discrete Fourier transform (DFT) on said overlapping frames;

calculating short-time power spectrum by summing a square of magnitude of samples of said complex spectrum lying in a band centered at each frequency sample;

calculating target gain for each frequency sample using said power spectrum and a given frequency-dependent compression function;

calculating a gain for each frequency sample of said complex spectrum using said target gain and selected attack and release times;

multiplying each frequency sample of said complex spectrum with said gain to obtain an output complex spectrum;

calculating an output segment by applying inverse discrete Fourier transform (IDFT) on said output complex spectrum; and resynthesizing an output signal by applying overlap-add on said output segment.

* * * * *